US011565279B2

(12) United States Patent
Lewis

(10) Patent No.: US 11,565,279 B2
(45) Date of Patent: Jan. 31, 2023

(54) FIRE PROTECTION SPRINKLER GUARD AND ASSEMBLY

(71) Applicant: Tyco Fire Products LP, Lansdale, PA (US)

(72) Inventor: Matthew James Lewis, Westerly, RI (US)

(73) Assignee: TYCO FIRE PRODUCTS LP, Lansdale, PA (US)

( * ) Notice: Subject to any disclaimer, the term of this patent is extended or adjusted under 35 U.S.C. 154(b) by 0 days.

(21) Appl. No.: 16/761,097

(22) PCT Filed: Nov. 2, 2018

(86) PCT No.: PCT/US2018/059040

§ 371 (c)(1),
(2) Date: May 1, 2020

(87) PCT Pub. No.: WO2019/090135

PCT Pub. Date: May 9, 2019

(65) Prior Publication Data

US 2020/0353496 A1 Nov. 12, 2020

Related U.S. Application Data

(60) Provisional application No. 62/581,346, filed on Nov. 3, 2017.

(51) Int. Cl.
*B05B 15/16* (2018.01)
*A62C 35/68* (2006.01)

(52) U.S. Cl.
CPC ..... *B05B 15/16* (2018.02); *A62C 35/68* (2013.01)

(58) Field of Classification Search
CPC ..... B05B 1/16; B05B 15/16; B05B 1/265; A62C 35/68; A62C 37/08; A62C 31/02; A62C 31/28
(Continued)

(56) References Cited

U.S. PATENT DOCUMENTS 1,469,336 A 10/1923 Rowley
3,797,746 A 3/1974 Gray et al.
(Continued)

FOREIGN PATENT DOCUMENTS

KR 100821215 B1 4/2008

OTHER PUBLICATIONS

International Search Report and Written Opinion for International Appl. No. PCT/US2018/059040, dated Jan. 3, 2019.

*Primary Examiner* — Christopher R Dandridge
(74) *Attorney, Agent, or Firm* — Foley & Lardner LLP

(57) ABSTRACT

A sprinkler assembly guard includes a base, a plurality of protective members, and at least one clip member. The base has a plurality of base members centered about a central axis. Each of the protective members having a first portion radially spaced from the central axis and a second portion affixed to one of the base members and extending radially toward the central axis, the first portions of the plurality of protective members being angularly spaced about the central axis to define a cage volume for housing a sprinkler assembly. The at least one clip member is engaged with the protective members to draw the base members radially inward. The second portion of at least one of the protective members includes a securement member extending from the second portion and axially spaced from the base to define a space therebetween for securely housing a portion of a sprinkler frame.

7 Claims, 3 Drawing Sheets

(58) Field of Classification Search
USPC ..... 169/37
See application file for complete search history.

(56) References Cited

U.S. PATENT DOCUMENTS 5,632,339 A 5/1997 Fenske et al.
5,893,418 A * 4/1999 Ponte ..... A62C 31/02
169/37

* cited by examiner

FIRE PROTECTION SPRINKLER GUARD AND ASSEMBLY

CROSS-REFERENCE TO RELATED PATENT APPLICATIONS

This application is a National Stage Application of PCT/US2018/059040, filed Nov. 2, 2018, which claims the benefit of and priority to U.S. Provisional Patent Application No. 62/581,346, titled "FIRE PROTECTION SPRINKLER GUARD AND ASSEMBLY," filed Nov. 3, 2017, the entire disclosure of which is incorporate herein by reference.

BACKGROUND

Automatic fire protection sprinklers include operational components such as, for example, fluid deflecting structures and thermally responsive trigger and sealing assemblies. In order to protect sprinklers and their operational components when installed in areas that make them susceptible to mechanical or physical damage, there are sprinkler guards.

SUMMARY

Embodiments of a sprinkler guard are provided that includes a structural arrangement for securing the guard about a fire protection sprinkler. Embodiments provide for combined radial and axial structural engagement to secure the sprinkler guard about a sprinkler frame. The sprinkler guard can protect larger sprinklers, without the need for additional or complex screw clamping mechanisms, including sprinklers having a nominal K-factor over 8.0 11 to about 36 GPM/(PSI)$^{1/2}$ preferably ranging from about 11 to about 36 GPM/(PSI)$^{1/2}$ and more preferably having a nominal K-factor of 25.2 GPM/(PSI)$^{1/2}$. In some embodiments, the structure does not significantly negatively impact the fluid distribution performance of the sprinkler.

An embodiment of a guard for a sprinkler assembly, the guard includes a base having a plurality of base members centered about a central guard axis and a plurality of protective members angularly spaced about the central axis to define a cage volume for housing a sprinkler assembly. At least one clip member engaged with the protective members to draw the base members radially inward. Each of the protective members has a first portion radially spaced from the central axis to define a cage volume fix housing a sprinkler assembly and a second portion affixed to one of the base members and extending radially toward the central axis. The second portion of one or more of the protective members includes a securement member extending from the second portion and axially spaced from the base to define a space therebetween for securely housing a portion of a sprinkler frame.

An embodiment of a sprinkler assembly includes a sprinkler frame with a body defining an internal passageway having an inlet and an outlet axially spaced apart along a sprinkler axis. The body has outer surface profile including a tool engagement portion, a pipe engagement portion and a relief portion between the tool and pipe engagement portion. A guard is disposed about the sprinkler frame that includes a base having a pair of base members centered about the sprinkler frame body and engaged with the relief portion of the body. The guard includes a plurality of protective members, each of the protective members having a first portion radially spaced from the central axis and a second portion affixed to one of the base members and extending radially toward the sprinkler frame. The first portions of the plurality of protective members are angularly spaced about the central guard axis to define a cage volume for housing the sprinkler frame. At least one clip member is engaged with the protective members to radially secure the base members about the relief portion. The second portion of at least one of the protective members includes a securement member extending from the second portion and axially spaced from the base to define a space therebetween for housing a portion of the tool engagement portion.

In some embodiments, the guard provides a structural arrangement for axially engaging and securing the guard about the sprinkler. In addition, the sprinkler guard radially engages the sprinkler frame.

In some embodiments, a method of guarding a sprinkler having a body including a tool engagement portion, a pipe engagement portion and a relief portion between the tool and pipe engagement portions is provided. The method includes radially engaging the relief portion of the sprinkler body with a guard base; and axially housing the tool engagement portion of the sprinkler body between a securement portion and the base of the guard.

BRIEF DESCRIPTION OF THE DRAWINGS

The accompanying drawings, which are incorporated herein and constitute part of this specification, illustrate embodiments of the present disclosure, and together, with the general description given above and the detailed description given below, serve to explain the features of the present disclosure. It should be understood that the disclosed embodiments are not the totality of the present disclosure but are examples of the present disclosure as provided by the appended claims.

DETAILED DESCRIPTION

Figure 1A:
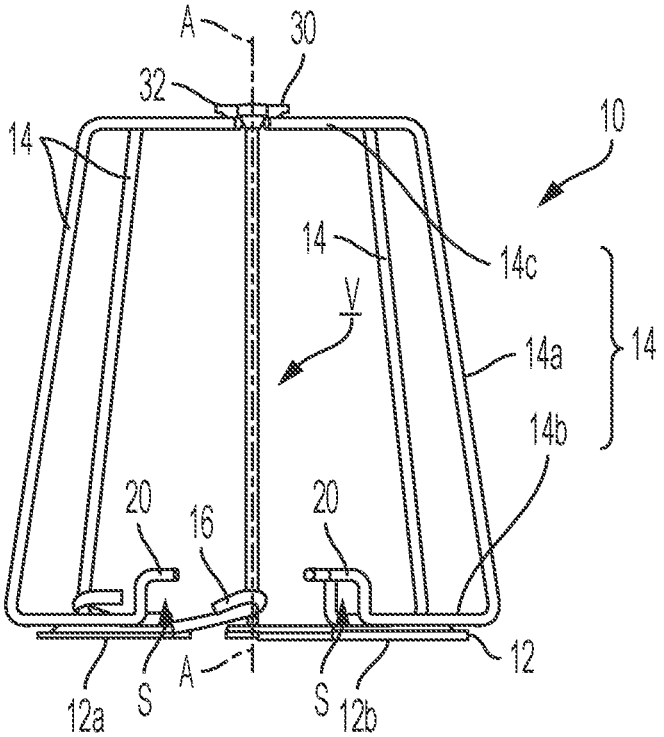
FIG. 1A is a side view of an embodiment of a protective sprinkler guard.

The present disclosure relates generally to the field of fire protection sprinklers. More particularly, the present disclosure relates to a fire protection sprinkler guard and assembly. Sprinkler guards includes a group of protective bars surrounding a base plate forming a cage to protect a sprinkler. The bars splay part to open the base plate for receipt of the sprinkler. A fire protection sprinkler frame includes a body having an external surface or profile defined by a tool engagement area, an external pipe thread and a thread relief area between the tool engagement area and the external pipe thread. When installing the guard over the sprinkler, the base plate is brought into radial engagement with the thread relief and secured in place by drawing the bars inward and locking them in place by an adjustable guard clip.

In some embodiments, the contact between the sprinkler guard and the sprinkler is limited to the base plate and the relief area between the tool engagement and pipe thread areas. In addition to resisting any impact, the guard and sprinkler engagement can be subject to the weight of the sprinkler and/or the geometry of the sprinkler. Accordingly, one factor in the effectiveness of the sprinkler is the size of the sprinkler, which can be related to the nominal K-factor of the sprinkler.

The internal passageway of the sprinkler body can define the discharge characteristics of the sprinkler. Discharge characteristics of a sprinkler can be quantified by a nominal K-factor of a sprinkler, which is defined as an average flow of water in gallons per minute through the internal passageway divided by a square root of pressure of water fed into the inlet end of the internal passageway in pounds per square inch gauge: $Q=K\sqrt{P}$ where P represents the pressure of water fed into the inlet end of the internal passageway through the body of the sprinkler, in pounds per square inch gauge (psig); Q represents the flow of water from the outlet end of the internal passageway through the body of the sprinkler, in gallons per minute (gpm); and K represents the nominal K-factor constant in units of gallons per minute divided by the square root of pressure expressed in psig. Because the nominal K-factor varies directly with the size of the internal passageway, the overall size of a sprinkler is directly related to the nominal K-factor. Protective guards can be configured for sprinklers sized and defined by a nominal K-factor ranging from 2.8 GPM/$(PSI)^{1/2}$ to about 8.0 GPM/$(PSI)^{1/2}$. Sprinklers having a larger K-factor including up to 25.2 GPM/$(PSI)^{1/2}$ can use a sprinkler guard. Guarded sprinkler assemblies can use securement mechanisms such as screw and clamping mechanisms to secure a sprinkler guard about the sprinkler frame.

The performance of fire protection sprinklers is defined by its fluid distribution to address a fire. The fluid distribution performance is defined by fluid distribution density measured in gallons per minute per square foot (gpm/sq. ft.) over the coverage area of the sprinkler, which is defined by the sprinkler-to-sprinkler spacing (ft.×ft.) for the sprinkler. For any sprinkler protection guard, it can be important that the guard not significantly negatively impact the fluid distribution performance of the sprinkler.

Figure 1B:
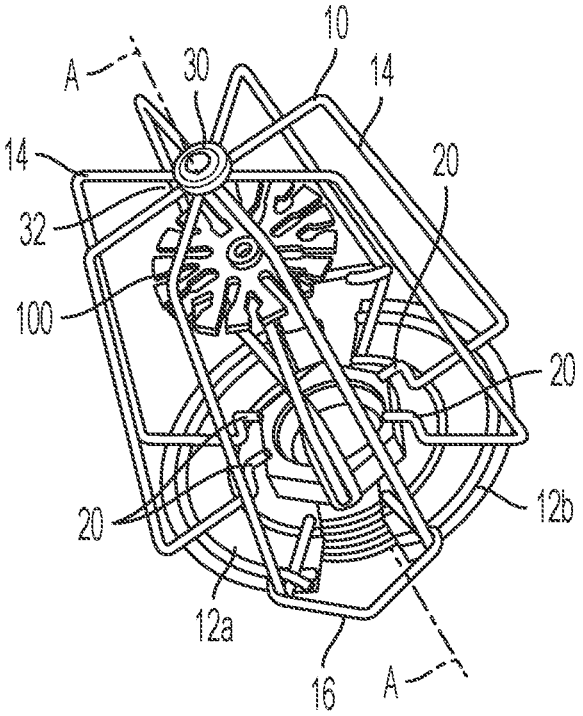
FIG. 1B is a perspective view of an embodiment of a sprinkler assembly using the protective guard.

FIGS. 1A and 1B depict a protective guard 10 for a fire protection sprinkler 100. The protective guard 10 includes a base 12 centered about a central guard axis A-A and a plurality of protective members 14 angularly spaced about the central axis to define a cage volume V for protecting and housing the fire protection sprinkler 100. The guard 10 can house and protect operational components of the fire protection sprinkler 100 in a manner than can accommodate the sprinkler, its geometry and weight without significantly interfering with the normal or expected fluid distribution of the sprinkler 10. In some embodiments, the guard 10 can house and protect a fire protection sprinkler with a sprinkler body sized to define a nominal K-factor of 25 (gpm/psi.$^{1/2}$). Moreover, the guard can protect the sprinkler 100 in either a horizontal or a vertical orientation. The guard 10 includes one or more securement members 20 that cooperate with the base 12 to secure the guard 10 about the sprinkler 100 in the axial direction while the base 12 secures guard 10 radially about the sprinkler frame 102. The base 12 can include two or more base members 12*a*, 12*b* centered about the guard axis A-A which cooperate together to radially engage and secure about a sprinkler frame 102. In some embodiments, the securement members 20 are axially spaced from the base members 12*a*, 12*b* to define a space S therebetween for containing or housing and axially securing a portion of the sprinkler 100.

In some embodiments, at least one and, in some embodiments, two or more of the protective members 14 include or incorporate the securement member 20. For example, at least four protective members 14 include a securement member 20 with two of the members 14 being angularly adjacent to one another and spaced apart by 45 degrees (45°) from one another. As depicted, a protective member 14 can be formed to include a first portion 14*a* and a second portion 14*b* in which the first portion 14*a* is radially spaced from the guard axis A-A to define the radial extents of the cage volume V. The second portion 14*b* of the protective member 14 can extend radially toward the central axis A-A and be affixed to one of the base members 12*a*, 12*b*. The second portion 14*b* can include the securement member 20 which extends away from the base 12*a*, 12*b* to define the space S for securely housing a portion of the sprinkler frame 100.

Figure 2A:
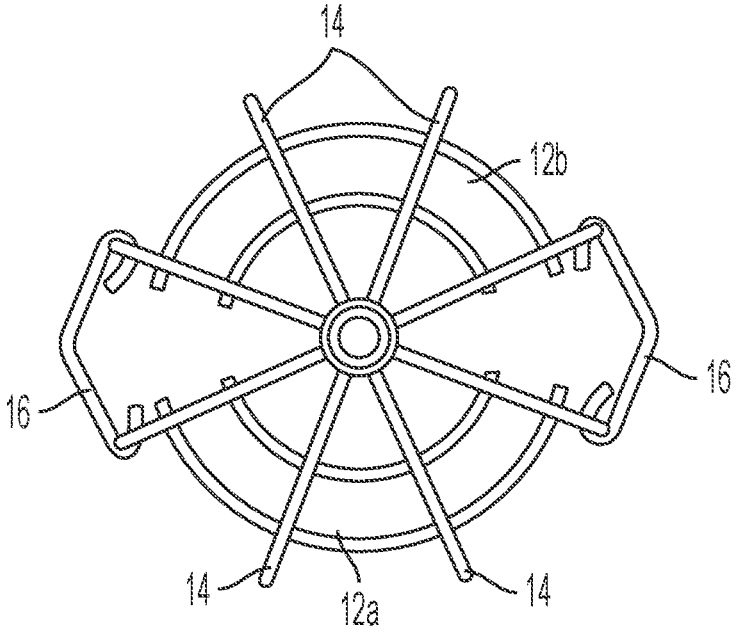
FIG. 2A is top view of the protective guard of FIG. 1.
Figure 2B:
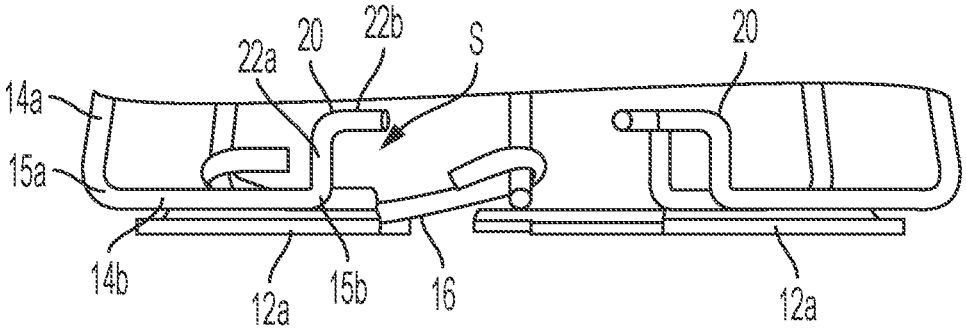
FIG. 2B is a detailed view of the protective guard of FIG. 1.

The protective members 14 can be formed as a unitary member. In some embodiments, as depicted in FIG. 2B, the second portion 14*b* of the protective member 14 has a first end 15*a* contiguous with the first portion 14*a* and a second end 15*b* contiguous with the securement member 20. In some embodiments, the member includes a first element 22*a* extending parallel to the central guard axis A-A and a second element 22*b* extending perpendicular to the central guard axis A-A. In some embodiments, the second element 22*b* extends radially in a direction to intersect the central guard axis A-A. Accordingly, the securement member 20 can be formed as an angled member extending from and, in some embodiments, contiguous with the second portion 14*b* of the protective member. In some embodiments, the securement member 20 can extend between the first and second ends 15*a*, 15*b* of the second portion 14*b* provided the space S formed is capable of housing the sprinkler frame in a manner as described herein. The first and second elements 22*a*, 22*b* of the securement member 20 can form or approximate a right angle between one another; in some embodiments, the first and second elements 22*a*, 22*b* may form a skewed angle provided the second element 22*b* can secure about a sprinkler flame 102. In the formation of the protective guard 10, each of the protective members 14 can include a third portion 14*c* which can converge to a junction 30 aligned or centered on the central axis A-A to sufficiently frame or enclose the cage volume V for protecting and housing the sprinkler. In a some embodiments, the junction 30 includes a disc or cap 32 to which the protective members 14 are affixed. The securement member 20 can be located axially between the base 12 and the junction 30.

The protective members 14 of one base 12*a* are adjustably joined to the protective members of the other base 12*b* to affix the guard 10 about the fire protection sprinkler 10. In some embodiments, the guard 10 includes one or more clip members 16 joining a protective member 14 affixed to the first base 12*a* to another protective member 14 affixed to the second member 12*b*. The clip member 16 has a locked position as depicted, for example, in FIG. 1B, which draws the protective members 14 and bases 12*a*, 12*b* toward one another to radially secure the guard about the sprinkler 100. The clip member 16 has an unlocked position (not depicted), which allows the protective members 14 to flex about the junction 30 and separate the base member 12*a*, 12*b* for release of the fire protection sprinkler 100.

In some embodiments, the securement member 20 can be separately formed and secured to the base 12 and its members 12*a*, 12*b*. For example, the securement member 20 can be an angled member directly secured to the base 12 and affixed to the base provided the securement member can provide a space for housing and protecting the sprinkler frame. In some embodiments, the securement member 20 can define a geometry such as, for example, a straight member affixed to the protective member 14 that is spaced from the base 12 to define the space S for housing and protecting the sprinkler frame. The protective members 14 can define various geometries provided the member defines a cage volume V. The protective member 14 can include a second portion b that defines a formation or surface for affixing to the base 12 without extending in the radial direction. For example, the second portion 14*b* can be a bulb formation or may be an elongate member that extends in a direction off the central guard axis A-A.

Figure 3A:
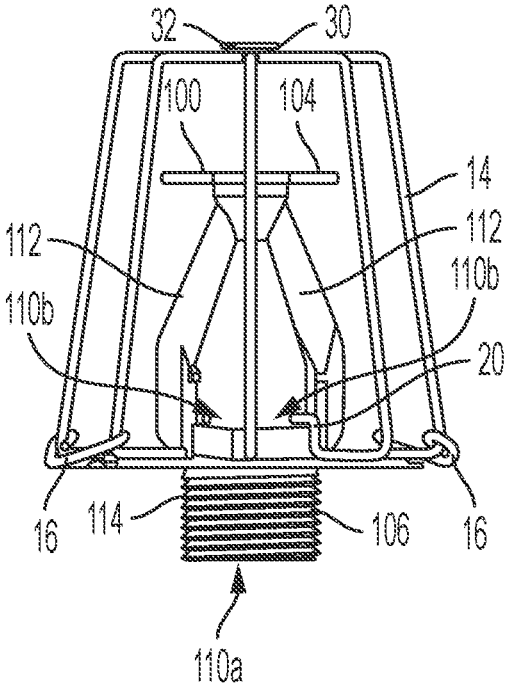
FIGS. 3A-3B show side and perspective view of the sprinkler assembly of FIG. 1B.
Figure 3B:
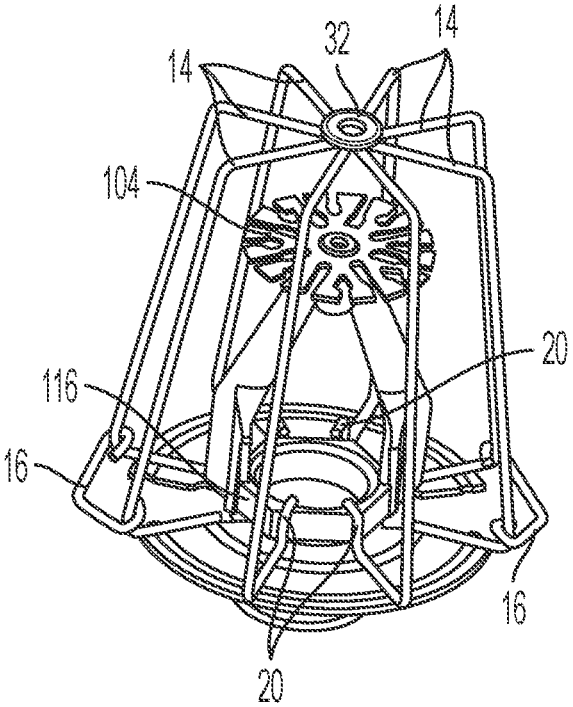

As depicted in FIG. 1B, the guard 10 can house and protect operational components of the fire protection sprinkler 100 such as, for example, the fluid deflection member 104 and/or the trigger and sealing assemblies (not shown) of the sprinkler. In FIGS. 1B, 3A and 3B are depicted embodiments of a guarded sprinkler assembly in which a fire protection sprinkler 100 is housed within the protective guard 10. The sprinkler 100 has a frame 102 with a body 106 defining an internal passageway 108 having an inlet 110*a* and an outlet 110*b* axially spaced apart along a sprinkler axis X-X. A pair of spaced apart frame arms 112 extend to locate the fluid deflector member 104 at a distance from the outlet 110*b*. Embodiments of an upright sprinkler 10 and its frame body define a nominal K-factor over 8.0 11 to about 36 GPM/$(PSI)^{1/2}$; in some embodiments, ranging from about 11 to about 36 GPM/$(PSI)^{1/2}$; in some embodiments, a nominal K-factor of 25.2 GPM/$(PSI)^{1/2}$. Accordingly, the protective guard 10 can house and protect a sprinkler 10 having a nominal ranging from about 11 to about 36 GPM/$(PSI)^{1/2}$ and in some embodiments has a nominal K.-factor of 25.2 GPM/$(PSI)^{1/2}$. The guard 10 can be used to protect sprinklers manufactured by JOHNSON CONTROLS, such as the Model ESFR-25 sprinkler.

In some embodiments, the sprinkler body 106 has an outer surface profile 114 including a tool engagement portion 114*a*, a pipe engagement portion 114*b* and a relief portion 114*c* between the tool and pipe engagement portion. The pipe engagement portion 114*b* can be an external thread such as, for example, an NET thread, for securement to a fluid supply pipe or fitting. The tool engagement portion 114*a* can have flat surfaces for engagement with a wrench or other sprinkler installation tool. The tool engagement 114*a* can define an end face 116 that circumscribes or encircles the outlet 110*b*. The relief portion 114*e* can define a reduction in the profile 114 between the tool engagement and pipe engagement portions 114*a*, 114*b*. In some embodiments, the tool engagement portion 114*a* is housed within the space S between the base members 12*a*, 12*b* and the securement members 20.

Figure 3C:
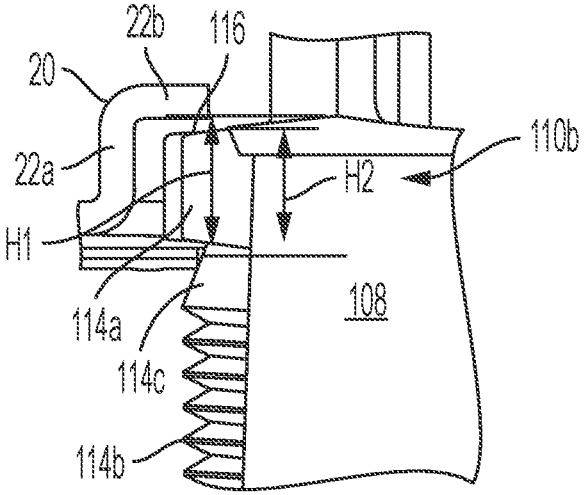
FIG. 3C is a detailed cross-sectional view of the sprinkler assembly of FIG. 1B.

FIGS. 3A and 3C depict side and detailed views of the protective guard 10 secured about the body 106. In the secured or locked configuration of the protective guard 10, the base members 12*a*, 12*b* radially surround and engage the relief portion 114*c* and the securement members 20 are disposed over the end face 116 to secure and house the tool engagement portion 114*a* within the space S between the securement members 20 and the base members 12*a*, 12*b*. More particularly, the first element 22*a* of the securement member 20 can rise axially to locate the second element 22*b* of the securement member 2.0 above the end face 116, In order to accommodate the body 106, the second element 22*b* can be located at a distance or height H1 from the base 12 that is greater than the maximum height H2 of the tool engagement portion 114*a* between the end face 116 and the relief portion 114*c*. Again, the securement member 20 supports the sprinkler 100 in either a vertical or a horizontal orientation with the guard 10 and sprinkler 100 coaxially aligned. Accordingly, there can be a close fit between the tool engagement portion 114*a* of the sprinkler 100, the securement member 20 and the base members 12*a*, 12*b*. In some embodiments, the closed or locked configuration of the sprinkler guard 10 forms an interference fit about the tool engagement portion 114*a*, which acts at least in part in the axial direction to support the sprinkler within the protective guard 10. In some embodiments, the space S and tool engagement portion define a comparative height ratio H1:H2 of that ranges from 1.3:1 to 1:1. In some embodiments, the tool engagement portion defines a height H2 of 0.3 inch and the secure member 2.0 defines a height 11 of the space S at 0.4 inch.

In some embodiments, the second element 22*b* is dimensioned so as to not radially extend into the flow path of the outlet 110*b* of the body 106. By not extending into the flow path, the securement members 20 may not significantly impact or alter the discharge characteristics and/or the fluid distribution performance of the sprinkler 100. FIGS. 1B and 3B depict the first and second base member 12*a*, 12*b* disposed about the centrally disposed sprinkler 100. The frame arms 112 are aligned along the central space or opening between the base members 112*a*, 112*b*. The assembly can include eight protective members 14 equiangularly spaced about the sprinkler 100. Four of the protective members 14 each include a securement member 20 and are located so that the securement members engage the sprinkler body 106 between the frame arms 112. Two clip members 16 are diametrically disposed about the base 12 and engaged with the other four protective members 14. In the locked position of the clip members 16, the base members 12*a*, 12*b* are radially drawn together and the securement members 20 are brought into position to house and secure the tool engagement portion 114*a* of the sprinkler frame body 106 to house and protect the sprinkler 100 in either a vertical or horizontal orientation.

In some embodiments, the guard 10 does not significantly negatively impact the fluid distribution of a sprinkler being protected. For a coverage area defined by one or more sprinklers at a given height, sprinkler spacing, and supplied fluid pressure, the sprinklers without the guard 10 define a distribution density. Comparatively, a sprinkler assembled and protected with the protective guard 10 will distribute fluid within an acceptable percentage of the fluid distribution performance of the unprotected sprinkler.

While the present disclosure has been disclosed with reference to certain embodiments, numerous modifications, alterations and changes to the described embodiments are possible without departing from the sphere and scope of the present disclosure, as defined in the appended claims. Accordingly, it is intended that the present disclosure not be limited to the described embodiments, but that it has the full scope defined by the language of the following claims, and equivalents thereof.

What is claimed is:

1. A sprinkler assembly guard, comprising: a base having a plurality of base members centered about a central axis; a junction opposite the base;

a plurality of protective members, each of the protective members having a first portion radially spaced from the central axis, a second portion affixed to one of the base members and extending radially toward the central axis from a first end of the first portion, and a third portion extending from a second end of the first portion to the junction, the second end closer to the central axis than the first end, the first portions of the plurality of protective members being angularly spaced about the central axis to define a cage volume for housing a sprinkler assembly; and at least one clip member engaged with a first subset of the protective members to draw the base members radially inward, the second portion of each protective member of a second subset of the protective members includes a securement member extending from the second portion of each of the protective members of the second subset and axially spaced from the base to define a space therebetween for securely housing a portion of a sprinkler frame, the securement member includes a first element extending parallel to the central axis and towards the junction away from the base and a second element extending perpendicular to the central axis, the first element between the base and the second element, the second element between the at least one clip member and the junction.

2. The sprinkler assembly guard of claim 1, comprising: the second portion of each of the protective members of the second subset has a first end contiguous with the first portion of each of the protective members of the second subset and a second end contiguous with the securement member.

3. The sprinkler assembly guard of claim 1, comprising: the second element extends in a direction towards the central axis and out of a flow path of the sprinkler frame.

4. The sprinkler assembly guard of claim 1, comprising: the second subset of the protective members includes at least two protective members diametrically opposed about the central axis.

5. The sprinkler assembly guard of claim 1, comprising: the second subset of the protective members includes four protective members with two angularly adjacent protective members of the four protective members being angularly spaced apart by 45 degrees.

6. The sprinkler assembly guard of claim 1, comprising: the junction is aligned with the central axis.

7. The sprinkler assembly guard of claim 1, wherein the first subset of the plurality of protection members are between the second subset of the plurality of protective members.

* * * * *